US006158628A

United States Patent [19]

Englram et al.

[11] Patent Number: 6,158,628

[45] Date of Patent: Dec. 12, 2000

[54] VISCOUS FLUID DELIVERY SYSTEM AND METHOD AND VALVE THEREFOR

[76] Inventors: Paul B. Englram, 377 Crestwood Rd., Wood Dale, Ill. 60191; Paul Holmquist, 2941 N. 75th Ave., Elmwood Park, Ill. 60707

[21] Appl. No.: 09/394,638

[22] Filed: Sep. 13, 1999

[51] Int. Cl.[7] ..... B67D 5/42

[52] U.S. Cl. ..... 222/389; 222/504

[58] Field of Search ..... 222/326, 389, 222/494, 504, 518, 559

[56] References Cited

U.S. PATENT DOCUMENTS

| | | | |
|---|---|---|---|
| 3,781,942 | 1/1974 | Coleman . | |
| 4,030,640 | 6/1977 | Citrin et al. | 222/504 |
| 4,215,802 | 8/1980 | Ornsteen | 222/504 |
| 4,274,561 | 6/1981 | Andersson . | |
| 4,375,275 | 3/1983 | Argazzi . | |
| 4,622,239 | 11/1986 | Schoenthaler et al. . | |
| 4,784,582 | 11/1988 | Howesman . | |
| 4,848,606 | 7/1989 | Taguchi . | |
| 5,735,434 | 4/1998 | Rayner . | |
| 5,788,127 | 8/1998 | Hanmer | 222/504 |
| 5,816,445 | 10/1998 | Gardos | 222/389 |

OTHER PUBLICATIONS

"ARO Color Station For High–Viscosity Materials", Ingersoll–Rand Company brochure, 9710–P.

*Primary Examiner*—Philippe Derakshani

[57] ABSTRACT

A system and method for delivering viscous fluid, having a viscosity in excess of about 100,000 SSU, wherein the system includes a reservoir for a viscous fluid under substantially uniform gas pressure, a dual mode dispense valve having a fluid supply port connected to the reservoir, a fluid dispense port, and a valve head opening and closing the dispense port, the valve head including a high flow valve part and a low flow valve part, a high flow valve part seat defining the dispense port and receiving the high flow valve part for seating the valve head to close the dispense port, the high flow valve part having a low flow dispense opening extending therethrough and a low flow valve part seat defining the opening, the high and low flow valve parts being reciprocally movable together and also relative to each other for dispensing from the dispense port fluid supplied from the reservoir to the supply port, alternately at a high flow rate with the high flow valve part removed from its seat for opening the dispense port, and at a low flow rate with the low flow valve part removed from its seat for opening the low flow dispense opening and with the high flow valve part seated on its seat. A gas knife is formed, for separating and dispensing viscous fluid from the valve head.

17 Claims, 7 Drawing Sheets

90
80
74
76
78
46
48
48
46
68
82
82
42
50
43
30
61
52
60
72
84
86
22
70
88
66
93
62
36
36
34
34
38
38
32
40
41
92
64
44
94
40
20
26
28
24

MODES OF OPERATION

1. NO FLOW
   A. OFF
   B. OFF
   C. OFF
   D. ON
   E. OFF

2. HIGH FLOW
   A. OFF
   B. ON
   C. OFF
   D. ON
   E. OFF

3. LOW FLOW
   A. ON
   B. ON
   C. ON
   D. ON
   E. OFF

4. STUTTER FLOW
   A. ON
   B. ON/OFF
   C. ON
   D. ON
   E. OFF/ON

VISCOUS FLUID DELIVERY SYSTEM AND METHOD AND VALVE THEREFOR

This invention relates to systems and methods for delivering viscous fluids and to dispense valves therefor. More particularly, the invention relates to a system and method in which a viscous fluid is delivered to a dispense valve by air or other gas pressure.

BACKGROUND OF THE INVENTION

The processing of viscous fluids having viscosities on the order of about 100,000 SSU (Saybolt Seconds Universal) or greater has required expensive, space consuming and extensive equipment to deal with the problems involved in removing such materials from their containers, transporting the materials to delivery points and modulating their flow, and providing dispense valves that will accurately deliver the materials to receptacles, especially when the materials are blended in the receptacles, which must be done accurately. Current practice involves the use of heavy duty pump systems mounted on large drums in which the materials are supplied. The systems may be computer-operated, using software programs provided for different recipes or formulations, as in a blending of colors. For those smaller operations that cannot afford or provide for such relatively complex and expensive systems, a blending of the viscous materials may be done essentially manually. An unfilled demand exists for an automated system that is affordable, compact, relatively simple in construction and operation, accurate, and versatile. There is a large need for such a system for delivering heavy paste ink as used in printing operations, for example, and other materials such as construction and assembly adhesives, caulkings, and other high viscosity materials, especially "stringy" materials giving rise to flow and delivery problems, including vexing problems of inaccuracy and misdirected delivery of the materials to their receptacles.

SUMMARY OF THE INVENTION

An important object of the invention is to provide a viscous fluid delivery system and method which overcome the cost, space, complexity, and accuracy problems that exist, while making available to current non-users of such systems an affordable, accurate, and efficient system.

Another important object is to provide a viscous fluid delivery system in which the prior delivery means are replaced by means for supplying the viscous fluid under gas pressure in a system that includes a dispense valve uniquely adapted for cooperation with the fluid supply means.

Another important object is to provide a dispense valve having the foregoing characteristics of accuracy, reliability, rapid dispensing, simplicity, and affordability.

A preferred viscous fluid delivery system, in accordance with the invention, includes a reservoir for a viscous fluid, means for applying substantially uniform gas pressure to viscous fluid in the reservoir, a dual mode dispense valve having a fluid supply port connected to the reservoir for supplying fluid under such pressure to the port, the valve having a fluid dispense port and a valve head opening and closing the dispense port, the valve head including a high flow valve part and a low flow valve part, a high flow valve part seat defining the dispense port and receiving the high flow valve part for seating the valve head to close the dispense port, the high flow valve part having a low flow dispense opening extending therethrough and a low flow valve part seat defining the opening, the high and low flow valve parts being reciprocally movable together and also relative to each other for dispensing from the dispense port the fluid supplied to the supply port, alternately at a high flow rate with the high flow valve part removed from its seat for opening the dispense port, and at a low flow rate with the low flow valve part removed from its seat for opening the low flow dispense opening and with the high flow valve part seated on its seat.

In a preferred embodiment, means are provided for interengaging the high and low flow valve parts for conjoint reciprocal movement. The system also preferably includes means for reciprocally moving the low flow valve part, and means for controlling the operation of the moving means. It is further preferred that the moving means include a fluid-operated double acting cylinder.

A preferred dispense valve, in accordance with the invention, having a fluid supply port and a fluid dispense port, includes a valve head opening and closing the dispense port, the valve head including a high flow valve part and a low flow valve part, a high flow valve part seat defining the dispense port and receiving the high flow valve part for seating the valve head to close the dispense port, the high flow valve part having a low flow dispense opening extending therethrough and a low flow valve part seat defining the opening, the high and low flow valve parts being reciprocally movable together and also relative to each other for dispensing from the dispense port fluid supplied to the supply port, alternately at a high flow rate with the high flow valve part removed from it seat for opening the dispense port, and at a low flow rate with the low valve part removed from its seat for opening the low flow dispense opening and with the high flow valve part seated on its seat. Preferably, means are provided for interengaging the high and low flow valve parts for conjoint reciprocal movement.

Further preferably, the dispense valve is employed together with a double acting cylinder including a piston connected to the low flow valve part for reciprocally moving the latter part. The dispense valve preferably includes structure for forming a gas knife that separates and dispenses viscous fluid from the valve head.

The invention provides a method of delivering a fluid having a viscosity in excess of about 100,000 SSU, wherein the fluid is maintained under substantially uniform gas pressure, preferably in a reservoir, and the fluid is supplied to a dispense valve under such pressure.

BRIEF DESCRIPTION OF THE DRAWINGS

The drawings illustrate preferred embodiments of the viscous fluid delivery system of the invention, and components thereof. In the drawings, like elements are identified by like reference symbols in each of the views, and.

DESCRIPTION OF THE PREFERRED EMBODIMENTS

Figure 1:
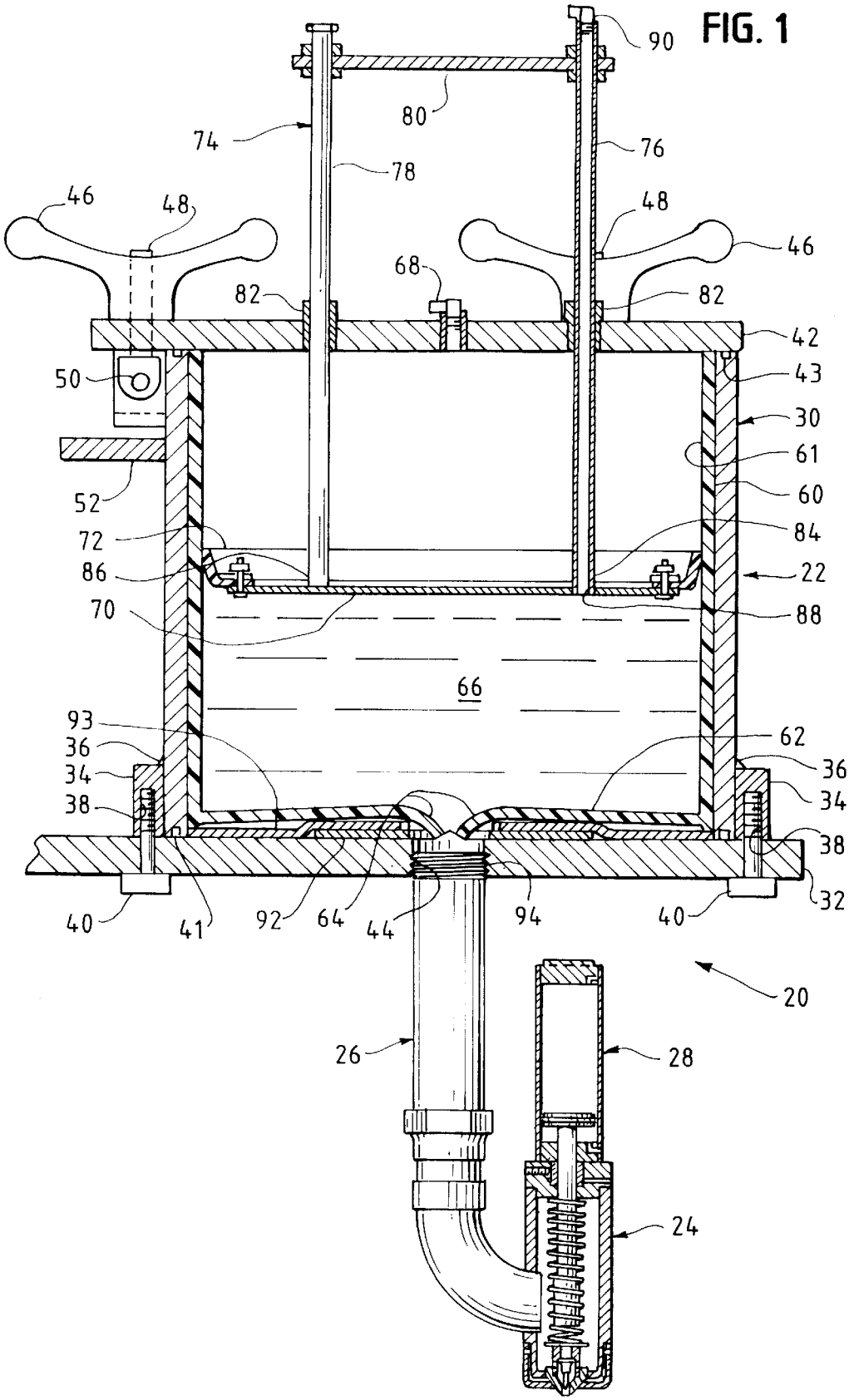
FIG. 1 is a vertical sectional and partly elevational view of the delivery system.

Referring to FIG. 1 of the drawings, a viscous fluid delivery system 20 according to the invention includes a reservoir or supply source 22 for a viscous fluid, a dual mode dispense valve 24 for dispensing a viscous fluid, a conduit 26 for conducting viscous fluid under gas pressure from the reservoir 22 directly to the valve 24, and a fluid-operated double acting cylinder 28 for reciprocally moving a valve head in the dispense valve 24.

Figure 9:
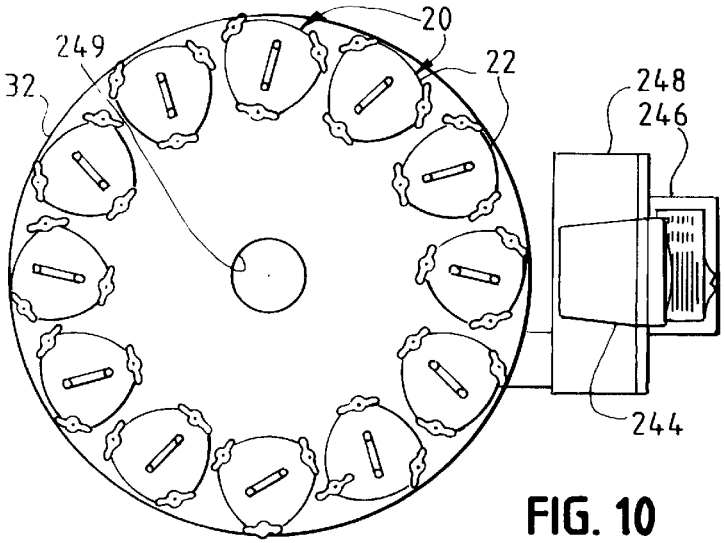
FIGS. 9 and 10 are schematic plan and side elevational views, respectively, on a reduced scale, of an assembly of delivery systems, illustrating a preferred manner of assembling a group of the systems for selective delivery of viscous fluids from respective systems to a receptacle in which the fluids are blended, as may be computer-operated.
Figure 10:
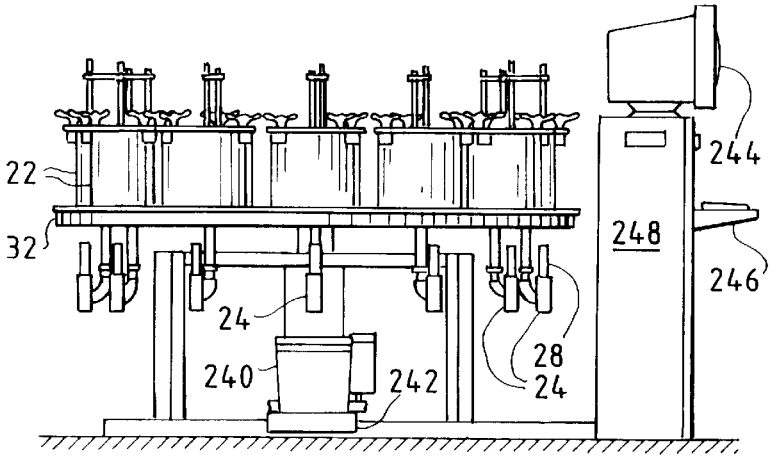

The reservoir 22 is hermetically sealed and pressure-resistant, and it includes a cylindrically tubular pressure-resistant housing 30 fixedly mounted on top of an indexing table or turntable 32. Three steel blocks 34 are equidistantly secured to the housing 30 around its perimeter at the base thereof, by means such as welds 36. The blocks are tapped in their bases, as at 38, and fastened to the indexing table 32 by means of bolts 40 extending from the bottom surface of the table through corresponding bolt openings therein and into threaded engagement with the blocks 34 in the tapped holes 38. As illustrated in FIGS. 9 and 10, twelve of the reservoirs 22, and of the systems 20, are mounted in a circle around the indexing table 32, for rotation about the axis of the circle.

Continuing reference to FIG. 1, in particular, the housing 30 thereby is closed at its base by the table 38, where an O-ring seal 41 is inserted in the base. A pressure-tight cover or lid 42 is mounted on the upper end of the housing 30 and sealed by an O-ring seal 43 inserted in the upper end of the housing. Axially or centrally of the housing 30, a threaded cylindrical discharge opening or hole 44 extends through the table 32, beneath each housing 30 of each system 20.

The cover 42 is removably secured to the housing 30 by three wing nut design clamps 46 spaced apart around the periphery of the cover. The clamps 46 threadedly engage bolts 48 secured to the housing 30, one of which is mounted for pivotal movement together with the cover 42 about a pivot pin 50. After removing the other two clamps 46, the housing 30 may be opened by lifting one side of the cover 42 until the opposite side abuts on a cover stop 52 fixed to the outer surface of the housing.

In the illustrative embodiment, a fluid ink paste container or cartridge 60, formed of a suitable plastic in a cylindrical tubular shape, fits within the housing 30, against the inner wall surface thereof. The container is filled with high viscosity fluid ink paste 66. The bottom wall or base 62 of the container is cut in an "X" pattern to provide flaps 64 in the center of the wall prior to inserting the filled container 60 in the housing 30. The high viscosity ink paste may be above about 100,000 SSU, frequently at about 200,000 SSU viscosity, and it will flow through the bottom opening defined by the flaps 64 only under pressure applied to its upper surface.

Figure 13:
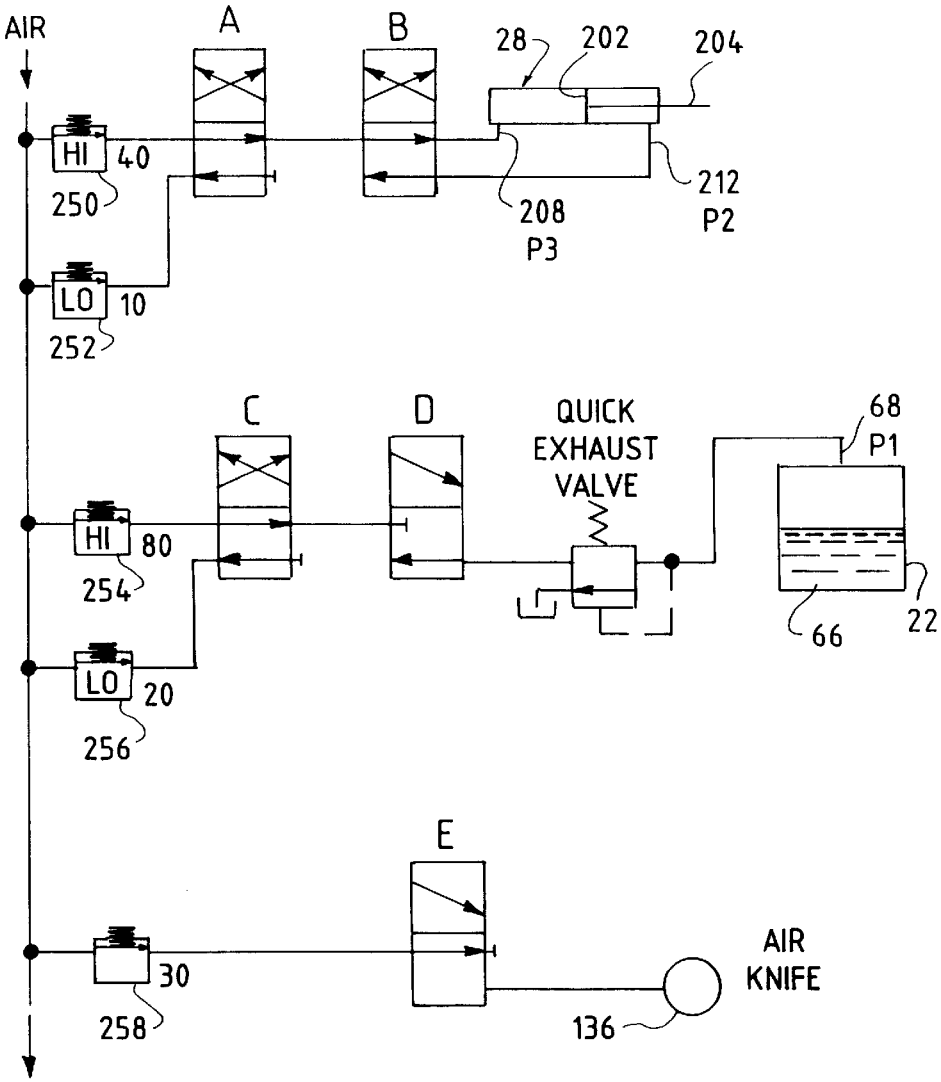
FIG. 13 includes a diagram of system controls and a chart of the modes of operation of solenoid valves thereof, as employed in a preferred embodiment of the invention, illustrated by U.S.A.S.I. standard symbols.

An air supply fitting 68 is mounted on the cover 42 in communication with the interior of the housing 30, for connection to a source of uniform air pressure, such as illustrated in FIG. 13. While air pressure is preferred, it will be apparent that another inert gas, such as nitrogen, might be used if desired.

A follower plate 70 is inserted in the container 60, and sits on the upper surface of the body of ink paste 66. The plate is exposed directly to the air under pressure supplied through the fitting 68. A flexible annular wiper 72 of preferably elastomeric material is secured around the perimeter of the follower plate 70, which is spaced slightly inwardly from the inner surface of the container 60. The wiper 72 is fastened to the radially outer edge of the follower plate 70, and bends upwardly, towards the mouth of the container 60. The wiper wipes the ink paste 66 from the side wall surface as the paste liquid level descends in the container 60 towards its bottom wall 62, as pressure is applied to the upper surface of the follower plate 70.

The follower plate 70 is supported and guided by a frame 74 made up of two sliding tubes 76 and 78 joined together at their outer ends by a lifting bar 80. The tubes are mounted in bushings 82 in turn mounted in corresponding openings extending through the cover 42, for longitudinal sliding movement inwardly and outwardly therein. The inner ends 84 and 86 of the respective tubes 76 and 78 are fixedly secured to the follower plate 70, for supporting the plate during its movements and withdrawing the plate and frame from the container when the ink fluid 66 has been emptied from the container. In order to assist in removal of the frame 74, the inner end 84 of one tube 76 registers with a similar circular opening 88 in the plate 70, for conduction of air or other gas beneath the plate to separate the plate from residual fluid 66. An air supply fitting 90 is connected to the outer end of tube 76, for connection to a source of compressed air or other gas.

Annular gaskets 92 and 93 are inserted between the upper surface of the indexing table 38 and the bottom wall 62 of the container 60, surrounding the flaps 64, for the prevention of leakage of the fluid 66 underneath the container wall 62. The ink paste 66 is discharged through the opening formed by the flaps 64, into the conduit 26. The receiving upper end 94 of the conduit 26 is threaded, for threaded connection to the indexing table 32 in the threaded opening 44 therein.

The ink paste 66 is conducted directly to the dispense valve 24, in even flow, without need for the intervention of means such as a fluid pressure regulator to ensure that consistent fluid pressure is supplied to the valve.

FIGS. 2–8 illustrate particulars of the dispense valve 24 constituting a preferred embodiment of the invention. The valve is especially adapted for use in combination with the air or other gas pressure-propelled supply of viscous fluid from the reservoir 22 via the conduit 26 directly connecting the two. An accurate, efficient delivery system is provided by the use of the pressurized fluid-operated cylinder 28 for operating the valve 24.

Figure 5:
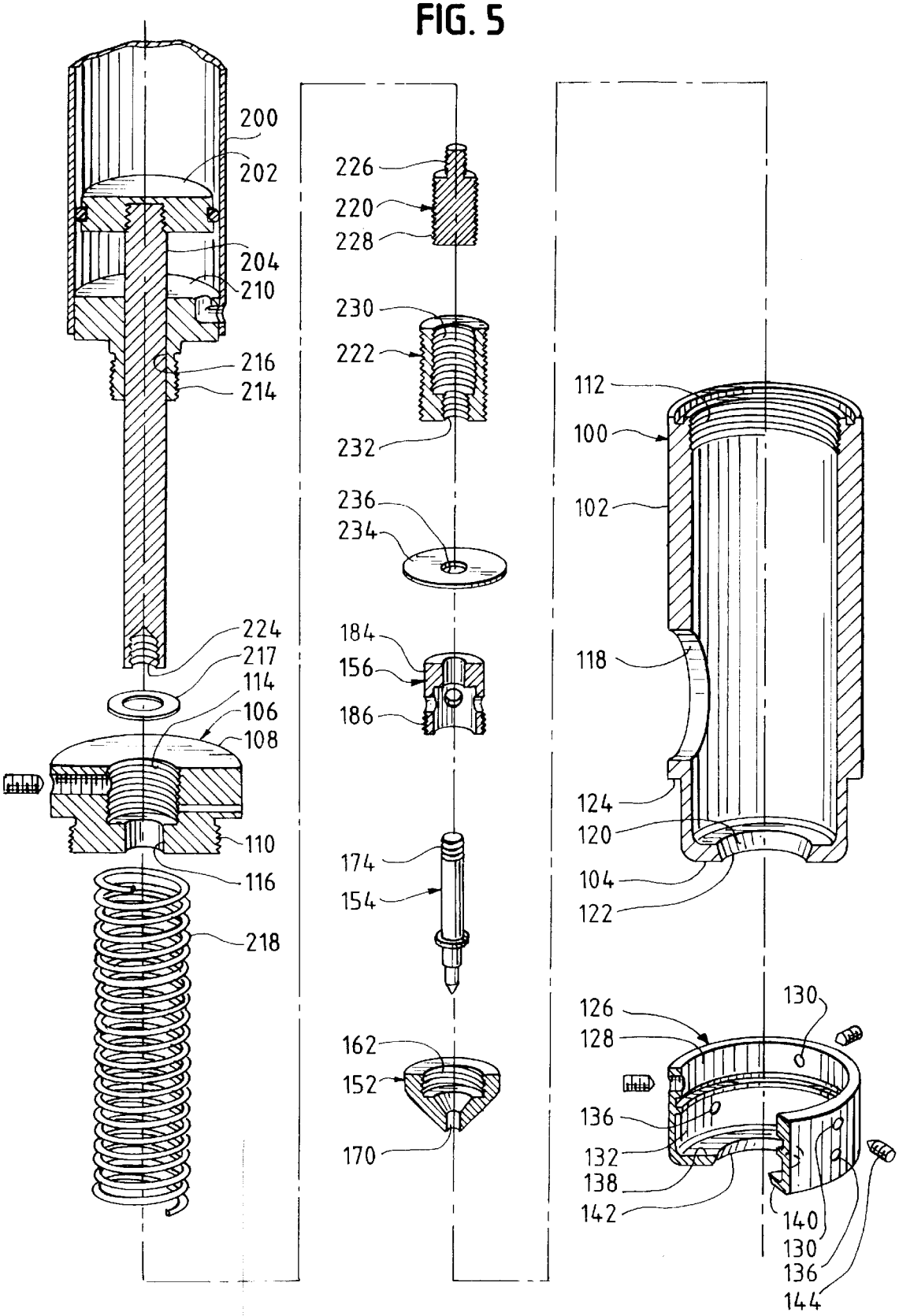
FIG. 5 is an exploded perspective and axial vertical sectional view, with parts broken off, of the assembly of FIGS. 2–4, on substantially the same scale.

Referring to FIG. 5, the dispense valve 24 includes a generally cylindrical tubular body 100 having a tubular wall 102 and an annular flange 104 extending radially inwardly from the wall 102 integrally therewith and partly closing the dispensing end of the body. A valve cap 106 includes a disc-like head 108 and an integral shank 110 of reduced diameter depending from the head. The shank 110 is externally threaded for mounting in a correspondingly female threaded opening 112 in the upper or inner end of the wall 102. The head 108 is provided with a central tapped cylinder mounting opening 114, and a coaxial piston rod bearing bore 116 extends from the mounting opening 114 to the inner or bottom end of the shank 110

The valve body side wall 102 is provided with a fluid supply port 118, where the fluid conduit 26 from the reservoir 22 intersects at its discharge end and is fixedly secured to the wall, by suitable means such as welding or brazing. The flange 104 of the body 100 terminates in an inwardly widening frustoconical high flow valve part seat 120 defining a fluid dispense port 122 at the base of the dispense valve 24.

The lower or outer end of the wall 102 is recessed annularly on its outer surface, and an annular external shoulder 124 is provided in the wall at the inner end of the recess. The wall 102 is telescopically received in a circular tubular air knife boot 126. The boot 126 includes an inner mounting ring section 128 abutting on the shoulder 124 and having three setscrew openings 130 therein. The boot 126 is secured to the wall 102 by setscrews 144 threaded in the openings 130.

The boot 126 includes an outer air manifold section 132 having an enlarged inner diameter and being slightly spaced apart from the wall 102, to form an annular air passageway 134 therebetween. Similarly, an annular bottom flange 140 integral with the manifold section 132 and extending radially inwardly therefrom has an inner surface 138 that is spaced apart from the flange 104 at the base of the valve body 100, to form a continuation of the air passageway 134. The boot flange 140 terminates in an outwardly widening frustoconical rim 142 that is adjacent to the dispense valve seat 120.

Two diametrically disposed air openings 136 extend through the manifold section 132. The openings 136 serve to receive compressed air lines, not shown, that communicate with the air passageway 134. Compressed air supplied to the passageway 134 is shaped into an annular "air knife" that discharges radially inwardly between the valve body flange 104 and the inner surface 138 of the boot flange 140, around the circumferences of the valve seat 120 and the boot rim 142. The air knife impinges on a valve head 150 therearound, following fluid dispensing, as described hereinafter.

Figure 2:
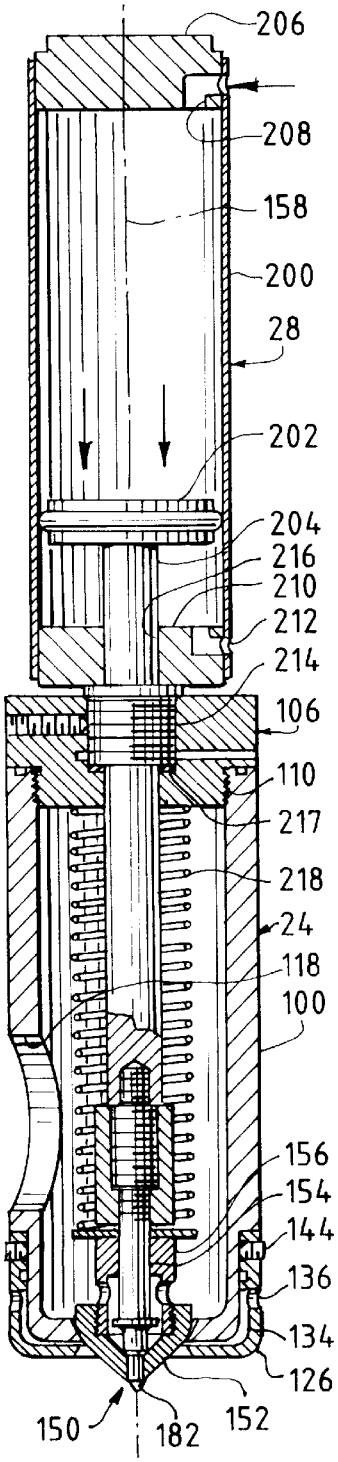
FIGS. 2, 3 and 4 are enlarged vertical sectional and partly elevational views, with parts broken away, of a dispense valve and an operating cylinder assembled therewith, illustrating, respectively, no flow, high flow, and low flow conditions or positions of the parts thereof.
Figure 3:
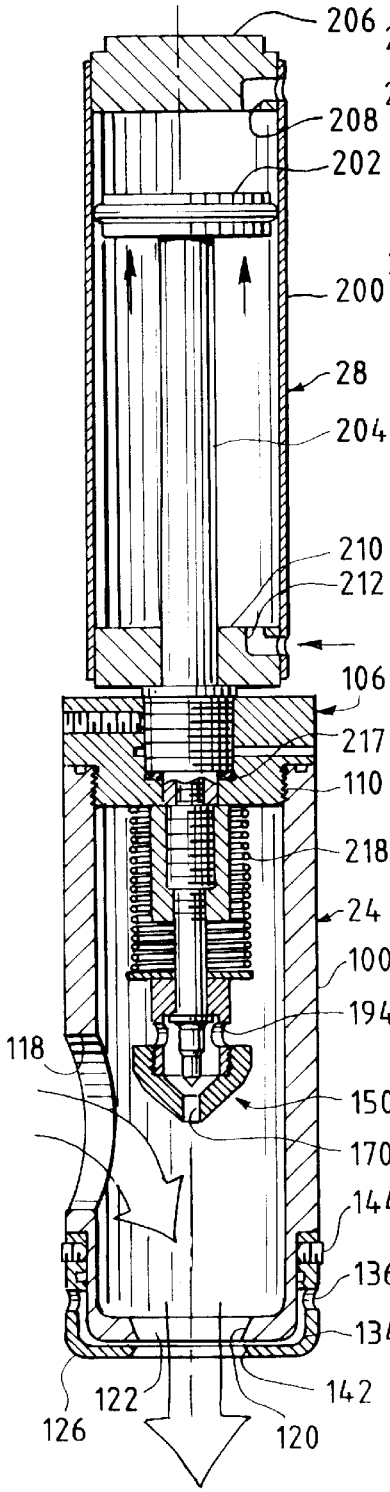
Figure 4:
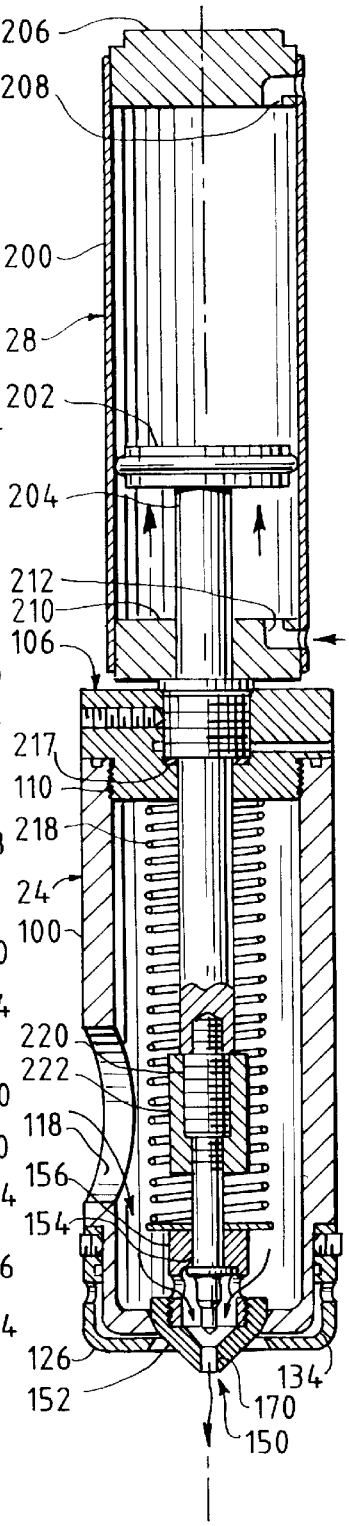

The valve head 150 of the dispense valve 24 is a three-piece assembly, shown assembled in FIGS. 2–4 and disassembled in FIGS. 5–8. Referring to FIGS. 5–8, the pieces include a high flow valve part 152, a low flow valve part 154, and a valve parts coupling 156. The valve head 150 is reciprocally movable in the valve body 100 on the longitudinal axis 158 (see FIG. 2) of the valve body and dispense valve 24, while the high flow valve part 152 and the low flow valve part 154 are reciprocally movable along such axis relative to each other. The valve head 150 and parts 152 and 154 in the illustrative embodiment are reciprocated by the action of the cylinder 28, as described in detail hereinafter.

Figure 8:
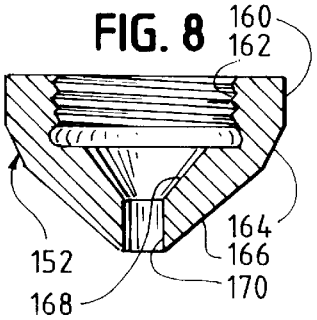

Referring to FIG. 8, the high flow valve part 152 is a hollow body that converges downwardly or outwardly, in the direction of fluid being dispensed, and it is adapted for controlling fluid flow through the dispense port 122. The part 152 is one-piece integral construction of a cylindrical female connecting section 160 internally threaded at 162 for connection to the coupling 156. An integral convergent frustoconical section 164 is finished on its outer surface for seating on the valve part seat 120 on the flange 104 and closing the dispense port 122 thereat. The part 152 terminates in an integral frustoconical tip 166 of greater convergency. An internal frustoconical convergent low flow valve part seat 168 extends outwardly or downwardly from the connecting section 160, and it terminates in a cylindrical low flow dispense opening 170 in the tip 166 that extends to the bottom end of the high flow valve part 152.

Figure 7:
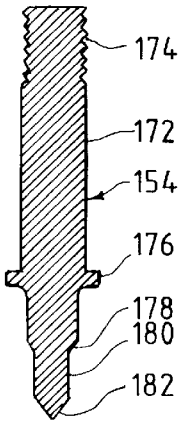

Referring to FIG. 7, the low flow valve part 154 is a one-piece integral structure including a cylindrical body 172 having an upper or inner threaded end 174 and a projecting annular stop 176 at the outer end of the body 172 and forming a right angle shoulder therewith. Beneath the stop 176, the part 154 extends cylindrically to a convergent frustoconical shoulder 178 providing an outer seating surface on the valve part. A cylindrical plug portion 180 of reduced diameter depends from the shoulder 178 and terminates in a conical tip 182.

The parts coupling 156 is a one-piece integral structure of a cylindrical body 184 and a depending tubular and perforated low flow valve part sleeve retainer 186. The body 184 is provided with an axial bearing bore 188, and the retainer 186 is provided with an enlarged coaxial passageway 190. A downwardly facing engagement shoulder 192 is formed at the juncture of the body 184 and the retainer 186. Four equidistantly spaced circular low flow openings 194 extend radially through the retainer 186.

The pieces 152, 154, and 156 of the valve head 150 are constructed and arranged for cooperative dual mode operation, as follows: the low flow valve part 154 is received in the central opening at the top of the high flow valve part 152, while the body 172 of the low flow valve part is inserted through the bore 188 of the coupling body 184, and the threaded end 196 of the coupling retainer 186 is received in threaded engagement with the female threaded section 160 of the high flow valve part 152. The low flow valve part 154 is axially reciprocally movable between a lower position with the plug 180 closing the low flow dispense opening 170, and an upper position, opening the low flow dispense opening 170. Specifically, the low flow valve part 154 may be moved downwardly or outwardly with respect to the high flow valve part 152, until the shoulder 178 on the low flow valve part 154 is seated on the low flow valve part seat 168, and the plug 80 is inserted in the low flow dispense opening 170 with the tip 182 extending therefrom, as a continuation of the outer surface of the adjacent tip 166 of the high flow valve part 152, thereby preventing flow through the opening 170. This condition is illustrated in FIG. 2.

The low flow valve part 154 may be axially moved upwardly or inwardly with respect to the high flow valve part 152, until the stop 176 on the low flow part 154 abuts on and engages the engagement shoulder 192 on the coupling 156. In this position, illustrated in FIG. 4, fluid flow may take place through the flow openings 194 in the retainer 186, into the passageway 190 and along the inner surface of the retainer, radially spaced apart from the valve part body 172, around the plug 180, and out of the low flow dispense opening 170. With the valve head 150 disposed as illustrated in FIG. 4, in which position the high flow valve part 152 closes the dispense port around the valve part seat 120, only low fluid flow from the dispense valve 24 can take place.

As noted above, the double acting cylinder 28 serves for reciprocally moving the valve head 150 and its high and low flow valve parts 152 and 154 in the preferred embodiment, the cylinder being coaxially mounted on the inner end of the dispense valve 24. Referring to FIGS. 2–5, the cylinder includes a cylindrical tubular body 200, and a piston reciprocally movable therein. The piston includes a circular piston head 202 and a piston rod 204 axially connected thereto and extending therefrom into the dispense valve 24. The outer end of the cylinder body 200 is sealed by an end cap 206 provided with a fluid supply and exhaust opening 208. The inner end of the cylinder body 200 is sealed by an end cap 210 provided with a fluid supply and exhaust opening 212. The inner end cap 210 has an integral depending threaded shank 214. The cap 210 and its shank 214 are provided with a cylindrical bearing bore 216, in which the piston rod 204 reciprocates. In the preferred embodiments, air is supplied and exhausted alternatively from the fluid openings 208 and 212, on opposite sides of the piston head 202. Alternatively, an hydraulic fluid may be employed in the cylinder 28, in a closed system.

The valve 24 is assembled with the cylinder 28 by inserting the piston rod 204 through the threaded opening 114 and the bearing bore 116 in the cap 106 of the valve. The shank 214 of the inner end cap 210 of the cylinder is threaded into engagement with the cap 106 of the valve, in its threaded opening 114. The body of the piston rod 204 is in bearing contact with the wall of the bore 116. A liquid-tight annular elastometric seal 217 (FIG. 2) is interposed between the shank 214 and the cap 106, around the piston rod 204.

A coil compression alignment spring 218 is emplaced around the piston rod 204, within the valve body 100. An axially adjustable assembly of an externally threaded step coupling 220 and an internally threaded sleeve coupling 222 serve to connect the piston rod 204 and the low flow valve part 154 fixedly in axial alignment. Thus, referring to FIG. 5, the inner end of the rod 204 is tapped to provide a threaded recess 224, which receives an upper threaded stub 226 on the step coupling 220. A lower threaded body 228 of the step coupling 220 is received in an upper threaded opening 230 in the sleeve coupling 222. The low flow valve part 154 is inserted through the bearing bore 188 in the valve parts coupling 156, in bearing engagement of the body 172 therein. The threaded end 174 of the low flow valve part 154 is received in a corresponding lower threaded opening 232 in the sleeve coupling 222.

A washer-like spring stop 234 seats or rests on the upper surface on the valve parts coupling 156 for supporting and containing the alignment spring 218. The body 172 of the low flow valve part 154 extends freely through a central circular opening 236 in the stop 234, permitting relative movement therebetween. As illustrated in FIGS. 2 to 4, the spring 218 operates in compression between the stop 234 and the shank 110 of the valve cap 106, contributing to the downward or outward force exerted on the valve parts coupling 156 and the high flow valve part 152 fixed thereto.

As described more completely hereinafter, other forces acting upon the valve parts include the force of the fluid material supplied to the supply port 118, that acts to apply pressure to the high flow valve part 152, to cause it to be seated on the dispense valve seat 120, as illustrated in FIGS. 2 and 4. Further, in the condition illustrated in FIG. 2, the piston acts to place and hold the low flow valve part 154 in its closed position, seated on the seat 168 within the high flow valve part 152. In turn, the force applied to the low flow valve part 154 is transmitted to the high flow valve part 152, acting to seat the latter part.

On the other hand, in the conditions illustrated in FIGS. 3 and 4, the piston in the cylinder 28 acts to withdraw the low flow valve part 154 from the engagement of its shoulder with the seat 168 on the high flow valve part 152, to a position spaced apart relative to the high flow valve part. In the condition illustrated in FIG. 3, with the low flow valve part stop 176 engaging the coupling shoulder 192, the upward or lifting force of the piston is sufficiently great to overcome the forces of the supply fluid and the spring 218, and lift the entire valve head 150 off of the high flow valve part seat 120. High flow of the fluid is permitted, from the reservoir 22, into the supply port 118, and out of the dispense port 122, bypassing the valve head 150.

Figure 12:
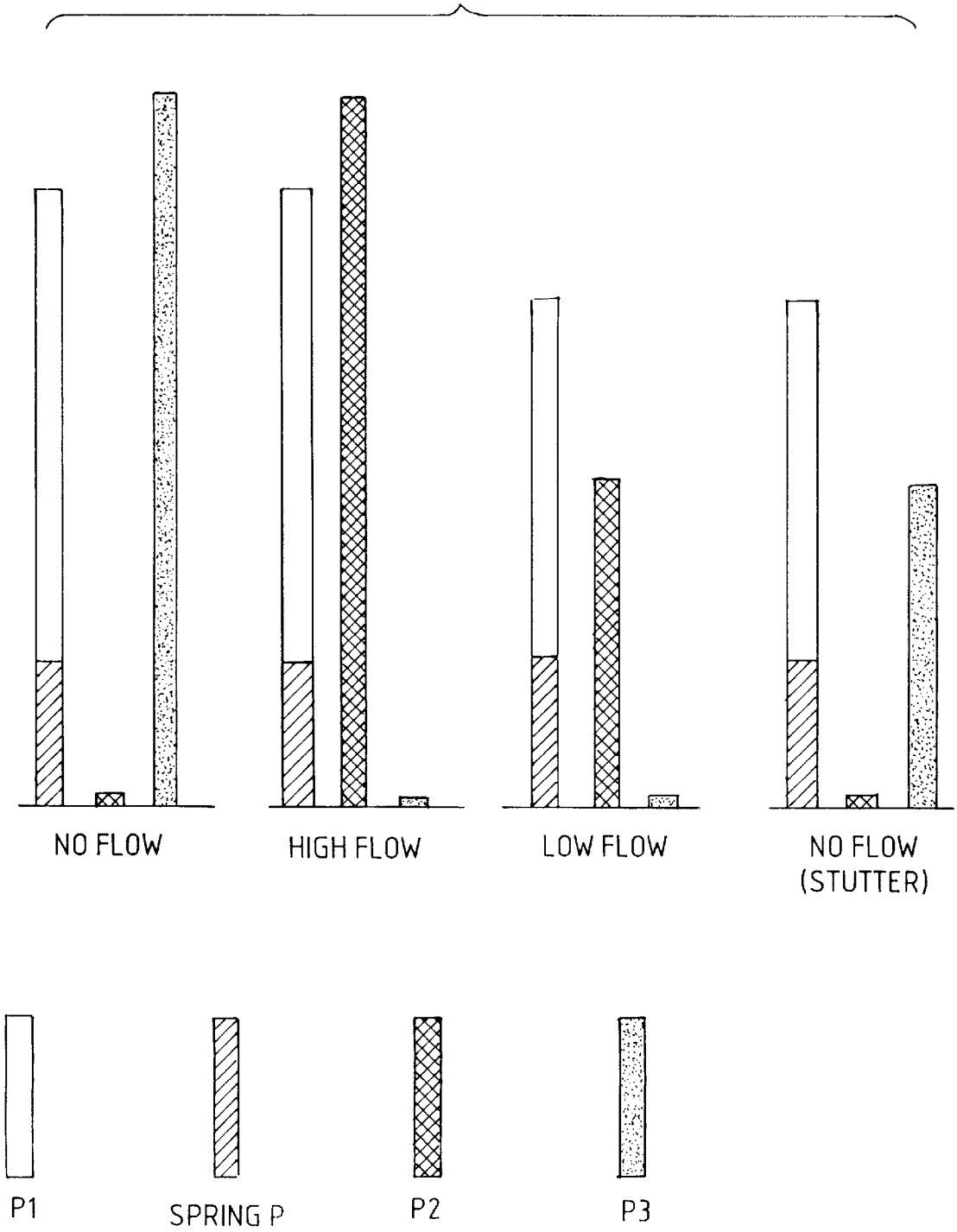
FIG. 12 is a composite of bar charts illustrating forces applied by several pressures employed in operation of the delivery system, illustrated qualitatively and not to scale, in several of the conditions of the system.

In the condition of FIG. 4, the pressure of the supply fluid together with the spring 218 is sufficient to hold the high flow valve part 152 in its position seated on the high flow valve part seat 120, while the upward or outward force of the piston in the cylinder 28 is sufficient to move the low flow valve part 154 into a position spaced apart from the low flow valve part seat 168, but insufficient to overcome the supply fluid pressure and the spring pressure. This condition provides for and permits low fluid flow through the supply port 118, into the valve parts coupling 156, and out of the low flow dispense opening 170 in the high flow valve part 152. These relationships among the forces applied for operating the dispense valve 24 are illustrated by the charts of FIG. 12.

The operation of the dispense valve 24 thus is responsive to the several pressures involved, and for smooth, accurate functioning, it is important that fluctuations in the pressure exerted by the viscous fluid supplied to the supply port 118 be prevented. This object is accomplished in the invention by the provision of the reservoir 22 for the viscous fluid 66, and the application of uniform gas pressure to the fluid in the reservoir. The fluid under such pressure then is conducted from the reservoir directly to the dispense valve supply port, without need for intervening pressure regulating means.

Referring to FIGS. 9 and 10, the delivery system 20 of the invention is especially advantageous, in that a group or bank of systems is mountable for movement relative to a portable fluid receptacle or receiver 240. Ink for a printing press or the like, for example, may be dispensed to the receptacle 240 and blended or compounded therein. In the illustrative arrangement, twelve systems 20 are mounted in a circle around the index table or turntable 32. The index table is mounted for rotational movement about its axis, and in operation, is rotated up to 180 degrees in each direction for positioning one of the systems 20 over the receptacle 240.

Figure 11:
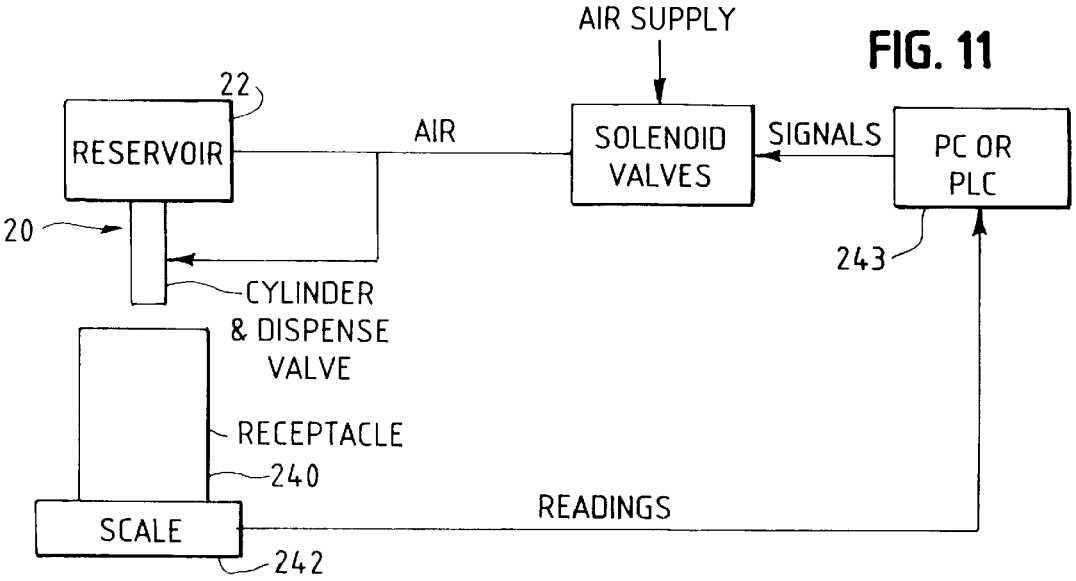
FIG. 11 is a flow diagram for each delivery system unit, according to a preferred method of operation.

The receptacle 240 is mounted on a scale 242, which is electronically connected to a computer 243 having a monitor 244 and keyboard 246. As illustrated in FIG. 11, a personal computer or a process logic computer 243 transmits signals to solenoid valves that control the operation of the system 20. The solenoid valves are mounted in a cabinet 248, which also mounts the computer. The computer is programmed to fill any number of recipes for the composite fluid that is ultimately formulated in the receptacle 240.

Air at appropriate pressures is transmitted through air pressure lines or tubes, not illustrated, that extend from the solenoid valves in the cabinet 248 to a central access opening 249 in the index table 32. The air lines are supplied below the table and extend through the access opening 249 and to their respective systems 20. It will be apparent that the foregoing arrangement is exceedingly compact, accessible, and affordable to the many potential small users in various industries that utilize high viscosity fluids.

The solenoid valves in the diagram of FIG. 11 are represented in the diagram of solenoid valve controls illustrated in FIG. 13. The solenoid valves are represented by United States of America Standards Institute (U.S.A.S.I.) standard symbols. Solenoid valves A, B, and C are two-position, four-connection valves. Solenoid valves D and E are two-position, three-connection valves.

Solenoid valves A and B control the air pressures operating the cylinder 28. Air lines to the solenoid valves A and B are regulated by modulating diaphraghm regulators 250 and 252. The respective regulators are a high pressure regulator 250 delivering 40 p.s.i.g. air pressure, and a low pressure regulator 252 delivering 10 p.s.i.g. air pressure. The solenoid valves A and B are shown as off or inactivated, so that when air is supplied from the main, high air pressure P3 at 40 pounds is supplied to the air opening 208 above the piston head 202 (see FIG. 2), while air is substantially exhausted from the air opening 212 beneath the piston head 202.

Solenoid valves C and D control the air pressure on the fluid 66 in the reservoir 22, as supplied via the fitting 68 on the cover 42 (FIG. 1). Air lines to the valves C and D are regulated by modulating diaphraghm regulators 254 and 256. The respective regulators are a high pressure regulator 254 delivering 80 p.s.i.g. air pressure, and a low pressure regulator 256 delivering 20 p.s.i.g. air pressure. The solenoid valves C and D are shown as off or inactivated, so that no air pressure is applied to the fluid 66 in the reservoir 22.

Solenoid valve E controls the supply of air to the air knife produced or provided by supplying air to the air openings 136 in the boot 126 (See FIG. 5). The air line to the valve E is regulated by a modulating diaphraghm regulator 258, which delivers 30 p.s.i.g. air pressure to the valve E. Valve E when on or activated delivers air 30 p.s.i.g. air pressure to the air knife. The solenoid valve E is shown as off or inactivated.

Referring to the Modes of Operation chart in FIG. 13, mode number 1, no flow, charts the activation of the solenoids A through E when the dispense valve 24 is in the condition of FIG. 2. This valve condition constitutes the condition at the start of a dispensing operation, and also the condition following the high flow condition and preceeding the low flow condition, as illustrated in FIGS. 3 and 4, respectively. It will be seen from the chart that only the solenoid valve D is on or activated, whereby the pressure P1 applied to the fluid 66 in the reservoir 22 commences at 80 p.s.i.g. With both solenoid valves A and B off or inactivated, the pressure P3 applied above the piston head 202 is 40 p.s.i.g. The solenoid valve E is off, so that no air is delivered to the air knife.

In the sequence of operation of each of the dispense valves 24, the next condition is high flow, as illustrated in FIG. 3. It will be seen from charted mode number 2 in FIG. 13, high flow, that a pressure 40 p.s.i.g. is applied to lift the piston head 202 under pressure P2, while the pressure P1 on the fluid 66 remains at 80 p.s.i.g. From FIGS. 13 and 14, it will be seen that when the activation of solenoid B times out, pressure P3 is restored, to restore the dispense valve to the no flow condition following high flow, and the solenoid valve E is activated for a brief period of time, to provide a short burst of the air knife. The air knife separates, contains, and directs fluid on the surface of the valve head 150. The respective operating times are determined by the computer program, in response to the readings of the scale 242 (FIG. 1).

The dispense valve 24 then is placed in the low flow condition of FIG. 4, with the activation of the solenoid valves as charted in FIG. 13 for mode number 3. Thus, 10 p.s.i.g. of air pressure P2 is applied beneath the piston head 202. At the same time, 20 p.s.i.g. of air pressure P1 is supplied to the reservoir 22 for a period of time. When the solenoid valve B is inactivated, and with the dispense valve in no flow condition, the solenoid valve E is activated, to provide a short burst of the air knife (see FIG. 14).

Figure 14:
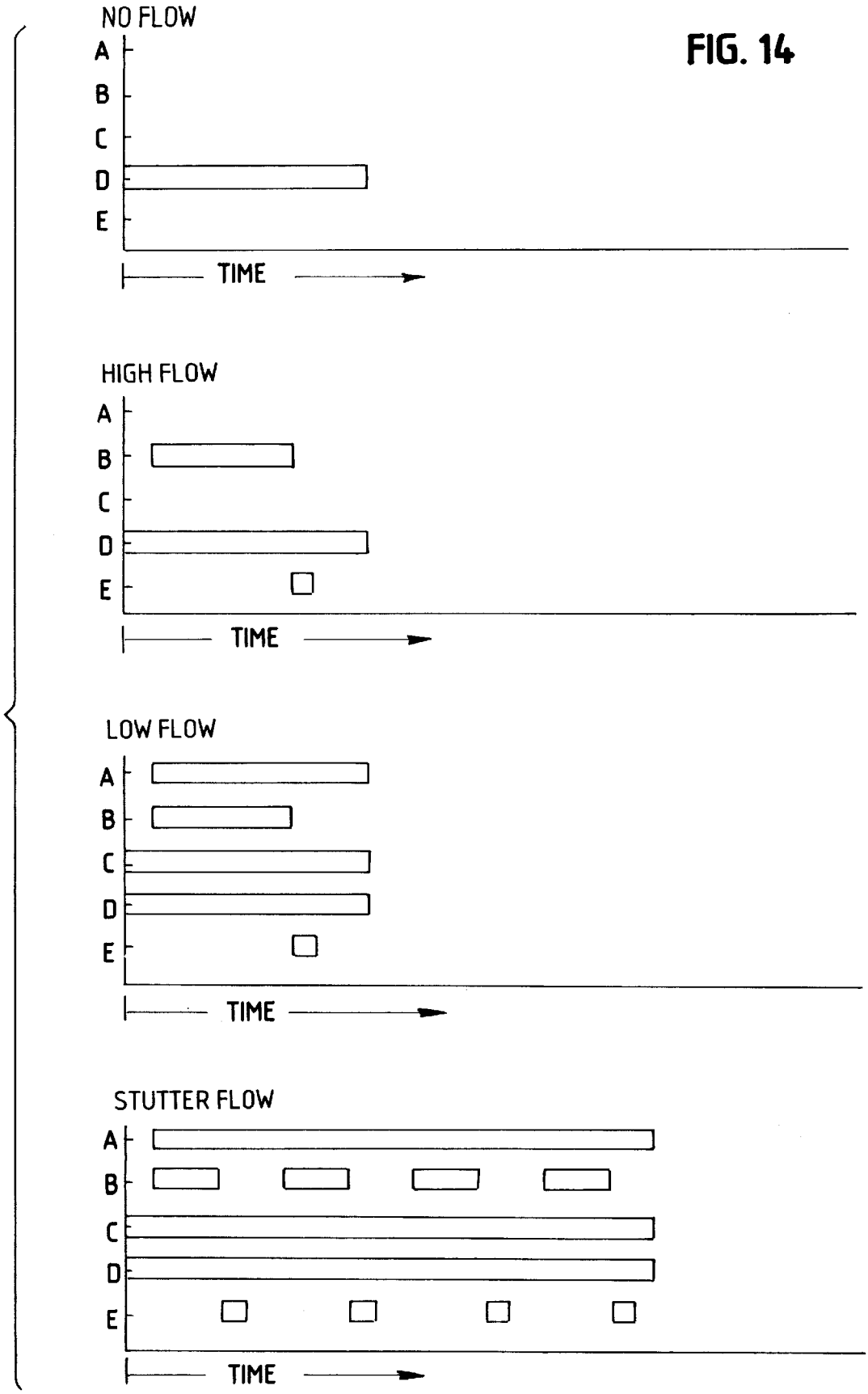
FIG. 14 is a composite of bar charts representing the timing of the solenoid valves illustrated in FIG. 13, shown qualitatively and not to scale, for several conditions of the dispense valve.

The operation of the dispense valve 24 next enters the stutter flow mode of operation number 4, wherein the valve operates alternately in low flow and no flow (stutter), under the respective forces illustrated in FIG. 12, and with the timing illustrated in FIG. 14. The solenoid valve B then alternates between its on and off, or activated and inactivated conditions, while the solenoid valve E correspondingly alternates between its off and on, or inactivated and activated conditions Consequently, the fluid 66 alternately is dispensed through the low flow dispense opening 170 (see FIGS. 4 and 8), and prevented as the plug 180 closes the opening 170 (see FIGS. 7 and 8). In the latter condition, the solenoid valve E is on or activated, supplying 30 p.s.i.g. air pressure to the air entrance openings 136 in the boot 126 (FIG. 5), to provide a burst of the air knife.

Referring to the charts of FIG. 14, each instance in which the solenoid valve B is off or inactivated, air at pressure P3 is supplied to the cylinder 28 above the piston head 202, while air is exhausted from the opening 212 beneath the piston head. The pressure P3 is 40 pounds when the solenoid valve A also is off, and 10 pounds when the solenoid valve A is on. When pressure P3 is applied, the dispense valve 24 returns to the no flow condition of FIG. 2, prior to each air knife burst.

When the precise amount of fluid 66 called for is dispensed by the system 20, it shuts down: the air to the system is cut off, and the solenoid valves are inactivated. Each system 20 used to prepare or formulate a recipe or blend of fluids 66 is operated in turn, following the computer program for such recipe.

OPERATION

Referring to FIG. 1, use of the delivery system 20 commences with the housing 30 empty, and the cover 42 open or off. An ink paste container or cartridge 60 or the like filled with ink of a selected color is opened to permit access to the interior of the cylindrical container wall 61. The bottom wall 62 of the container is slit in an "X" pattern, to provide the four flaps 64. The flaps register with the upper end of the conduit 26 in the table opening 44 when the container is lowered into the housing 30. The follower plate 70 is inserted in the mouth of the container wall 61, so that it is seated on the upper surface of the fluid ink paste 66.

With the cover 42 closed and sealed, pressurized air is supplied to the system through the fitting 68. The controls illustrated in FIG. 13 are set for no flow, thereby supplying air at 80 p.s.i.g. pressure to the upper surface of the follower plate 70. The pressure forces the fluid 66 out through the flap opening in the bottom wall 62 of the container, and then through the conduit 26 directly to the dispense valve 24. The follower wiper 72 bears against the interior of the wall 61, to provide a squeegee-like wiping action at the wall as the plate 70 follows the liquid level downwardly.

At the same time, the controls shown in FIG. 13, operating in no flow mode number 1, supply air at 40 p.s.i.g. to the upper opening 208 of the cylinder 28, to exert pressure on the top of the piston head 202, as illustrated in FIG. 2. The valve head 150 and its high and low flow valve parts 152 and 154, respectively, are in seated, closed positions under the fluid, spring, and piston pressures, as represented in the first no flow chart of FIG. 12.

Figure 6:
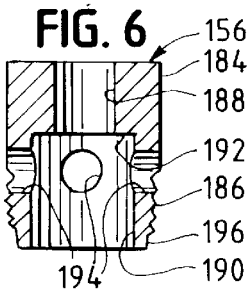
FIGS. 6, 7 and 8 are axial sectional views of three of the parts of the valve illustrated in the preceding views, enlarged with respect to the corresponding views of FIG. 5.

Referring to FIGS. 3, 12, 13 and 14, the delivery system next is operated at high flow, to rapidly dispense the bulk of the fluid 66 in the container 60 (FIG. 1). As seen in FIG. 12, the lifting force resulting from the application of pressure P2 is greater than the combined closing forces of pressure P1 and spring 218 acting on the valve head 150. Referring to FIGS. 6 and 7, the stop 176 on the low flow valve part 154 engages the engagement shoulder 192 on the valve parts coupling 156, to raise the entire valve head 150, to clear the supply port 118, as seen in FIG. 3. Fluid under the pressure P1 then flows freely through the supply port 118, beneath or bypassing the valve head 150, and through the dispense port 122.

At the end of the high flow dispensing operation, the valve 24 is first restored to the no flow condition of FIG. 2, and then placed in the low flow condition of FIG. 4. Referring to FIG. 13, low flow mode 3, 10 p.s.i.g. of pressure P2 is applied beneath the piston head 202 in the cylinder 28, while 20 p.s.i.g of pressure P1 is applied to the fluid 66 in the reservoir 22, resulting in the low flow forces illustrated in FIG. 12. The combined forces provided by the container pressure P1 and the spring pressure are greater than the force resulting from the application of pressure P2 beneath the piston head, so that the high flow valve part 152 is held down and remains seated to prevent high flow through the dispense port 122. The low flow valve part 154 is raised by the piston in the cylinder 28, so that the plug 180 of the part is removed from the low flow dispense opening 170 at the tip of the high flow valve part 152, and is spaced apart from its seat 168. Fluid flow then is permitted beneath the tip 182 of the low flow valve part 154, and through the opening 170, for dispensing from the dispense port 122 at a low flow rate.

At the end of the respective high flow and low flow modes of operation, when the activation of the solenoid valve B times out, the solenoid valve E is activated for a brief period of time, to provide an air knife that cleans off the valve head 150: radial air flow collides with and deflects away from the valve head, causing fluid on the tip of the head to be carried away and directed downwardly to the receptacle 240 (FIGS. 10 and 11).

The system 20 and the dispense valve 24 are uniquely adapted to accurately dispense the last of the fluid 66, as called for by the computer program. For this purpose, the system is operated in stutter flow, as illustrated in FIGS. 12–14. The low flow and no flow (stutter) forces charted in FIG. 12 alternate, according to the stutter flow timing diagram of FIG. 14. After each timed dispensing activation of solenoid valve B, a two-second burst of the air knife is generated by activation of the solenoid valve E. Dispensing of fluid is discontinued after the last of these air knife bursts, as controlled by the readings transmitted from the scale 242 to the computer and completion of the computer program for that recipe. The air pressure to the system 20 is discontinued, and the system is shut down.

Referring to FIG. 1, if it is desired to replace the container 60, air pressure is supplied to the follower lift fitting 90 on the frame 74, and pressurized air is supplied through the tube 76 therefrom, leading to the tube end 84 and the opening 88 in the follower plate 70, for discharge of air beneath the plate. The air pressure serves to separate the plate from the bottom wall 62 of the container 60 and/or fluid 66 remaining in the container. The frame 74 is raised, to raise the follower plate 70 to the top, whereupon the clamps 46 may be removed and the cover removed or pivoted to its upright position. The container 60 then may be removed and replaced by another filled container, following which another dispensing operation may take place.

The apparatus and method of the invention are similarly useful for dispensing other high viscosity materials, such as adhesives, caulkings, and others, that give rise to vexing problems and otherwise may be handled only manually or with very expensive equipment, and then with equipment problems, inaccuracies, and excessive space demands. The present invention is especially attractive to relatively small users, such as the thousands of printing facilities now limited to manual methods of supply and blending.

While preferred embodiments of the apparatus and method of the invention have been described and illustrated, it will apparent to those skilled in the art that various changes and modifications may be made therein within the spirit and scope of the invention. It is intended that all such changes and modifications be included within the scope of the claims.

We claim:

1. A viscous fluid delivery system which comprises:

a reservoir for a viscous fluid;

means for applying substantially uniform gas pressure to viscous fluid in said reservoir;

a dual mode dispense valve having a fluid supply port connected to said reservoir for supplying fluid under said pressure to said port;

said valve having a fluid dispense port and a valve head opening and closing said dispense port;

said valve head including a high flow valve part and a low flow valve part;

a high flow valve part seat defining said dispense port and receiving said high flow valve part for seating the valve head to close the dispense port;

said high flow valve part having a low flow dispense opening extending therethrough and a low flow valve part seat defining the opening;

said high and low flow valve parts being reciprocally movable together and also relative to each other for dispensing from said dispense port said fluid supplied to said supply port, alternately at a high flow rate with the high flow valve part removed from its seat for opening the dispense port, and at a low flow rate with the low flow valve part removed from its seat for opening said low flow dispense opening and with the high flow valve part seated on its seat.

2. A system as defined in claim 1 and including means for interengaging said valve parts for conjoint reciprocal movement.

3. A viscous fluid delivery system which comprises:

a reservoir for a viscous fluid;

means for applying substantially uniform gas pressure to viscous fluid in said reservoir;

a dual mode dispense valve having a fluid supply port, a fluid dispense port, and a valve head opening and closing said dispense port;

conduit means for conducting viscous fluid under said gas pressure from said reservoir directly to said supply port;

said valve head including a high flow valve part and a low flow valve part;

a high flow valve part seat defining said dispense port and receiving said high flow valve part for seating the valve head to close the dispense port;

said high flow valve part being reciprocally movable between a position seated on said high flow valve part seat and a position spaced apart from said seat in which viscous fluid conducted to said supply port may be dispensed through said dispense port at a high flow rate;

said high flow valve part having a low flow dispense opening extending therethrough and a low flow valve part seat defining said opening; and said low flow valve part being reciprocally movable relative to said high flow valve part between a position seated on said low flow valve part seat and closing said low flow dispense opening, and a position spaced apart from said latter valve part seat in which viscous fluid may be dispensed through said low flow dispense opening at a low flow rate when said high flow valve part is seated on said high flow valve part seat.

4. A system as defined as defined in claim 3 and including:

means for interengaging said valve parts for conjoint reciprocal movement;

means for reciprocally moving said low flow valve part; and means for controlling the operation of said moving means.

5. A system as defined in claim 4 and wherein said moving means comprises a fluid-operated double acting cylinder.

6. A system as defined in claim 5 and wherein said cylinder includes a piston connected to said low flow valve part for reciprocally moving the part, and said controlling means includes means for applying fluid pressure to respective ones of the opposite sides of said piston for respectively closing and opening said dispense port, and alternatively for applying fluid pressure in the same direction as but reduced relative to the pressure required to open said dispense port, to permit said high flow valve part to seat on said high flow valve part seat while said low flow valve part is in said position spaced apart from said low flow valve part seat in which viscous fluid may be dispensed through said low flow dispense opening.

7. A system as defined in claim 6 and including pressure control means for applying pressure to said viscous fluid in said reservoir sufficient to maintain said high flow valve part seated on said high flow valve part seat while said low flow valve part is in said spaced apart position thereof for said dispensing of viscous fluid through said low flow dispense opening.

8. In a viscous fluid delivery system including means for supplying a viscous fluid under substantially uniform pressure to a dispense valve supply port, a dual mode dispense valve for dispensing a viscous fluid, said valve having a fluid supply port connected to said supplying means and a fluid dispense port, and said valve comprising:

a valve head opening and closing said dispense port, said valve head including a high flow valve part and a low flow valve part;

a high flow valve part seat defining said dispense port and receiving said high flow valve part for seating the valve head to close the dispense port;

said high flow valve part having a low flow dispense opening extending therethrough and a low flow valve part seat defining the opening;

said high and low flow valve parts being reciprocally movable together and also relative to each other for dispensing from said dispense port said fluid supplied to said supply port, alternately at a high flow rate with the high flow valve part removed from its seat for opening the dispense port, and at a low flow rate with the low flow valve part removed from its seat for opening said low flow dispense opening and with the high flow valve part seated on its seat.

9. A system as defined in claim 8 and including means for interengaging said valve parts for conjoint reciprocal movement.

10. A dual mode dispense valve for dispensing a viscous fluid, said valve having a fluid supply port and a fluid dispense port, and said valve comprising:

a valve head opening and closing said dispense port, said valve head including a high flow valve part and a low flow valve part;

a high flow valve part seat defining said dispense port and receiving said high flow valve part for seating the valve head to close the dispense port;

said high flow valve part having a low flow dispense opening extending therethrough and a low flow valve part seat defining the opening;

said high and low flow valve parts being reciprocally movable together and also relative to each other for dispensing from said dispense port fluid supplied to said supply port, alternately at a high flow rate with the high flow valve part removed from its seat for opening the dispense port, and at a low flow rate with the low flow valve part removed from its seat for opening said low flow dispense opening and with the high flow valve part seated on its seat.

11. A valve as defined in claim 10 and including means for interengaging said valve parts for conjoint reciprocal movement.

12. A valve as defined in claim 11 and wherein said high flow valve part includes a conically-shaped tip extending through said dispense port when the part is seated on said high flow valve part seat, and including means for forming a gas knife impinging on said tip therearound to separate and dispense viscous fluid clinging to the tip.

13. In combination, a dispense valve as defined in claim 10, and a double acting cylinder including a piston connected to said low flow valve part for reciprocally moving the part.

14. A dual mode dispense valve for dispensing a viscous fluid, said valve having a fluid supply port and a fluid dispense port, and said valve comprising:

a valve head opening and closing said dispense port;

said valve head including a high flow valve part and a low flow valve part;

a high flow valve part seat defining said dispense port and receiving said high flow valve part for seating the valve head to close the dispense port;

said high flow valve part being reciprocally movable between a position seated on said high flow valve part seat and a position spaced apart from said seat in which viscous fluid supplied to said supply port may be dispensed through said dispense port at a high flow rate;

said high flow valve part having a low flow dispense opening therethrough and a low flow valve part seat defining said opening; and said low flow valve part being reciprocally movable relative to said high flow valve part between a position seated on said low flow valve part seat and closing said low flow dispense opening, and a position spaced apart from said latter valve part seat in which viscous fluid may be dispensed through said low flow dispense opening at a low flow rate when said high flow valve part is seated on said high flow valve part seat.

15. A valve as defined in claim 14 and including means for interengaging said valve parts for conjoint reciprocal movement.

16. In a viscous fluid delivery system including, in combination, a dispense valve having a fluid supply port and a fluid dispense port, said dispense valve including respective high flow and low flow valve parts individually reciprocally movable with respect to each other for dispensing fluid through said dispense port respectively at high and low flow rates, means for supplying viscous fluid to said supply port which comprise:

a reservoir for a viscous fluid;

means for applying substantially uniform gas pressure to said fluid in said reservoir; and conduit means for conducting said fluid under said pressure from said reservoir directly to said dispense valve supply port.

17. In a method of delivering a fluid having a viscosity in excess of about 100,000 Saybolt Seconds Universal to a dispense valve, wherein the fluid is contained in a sealed reservoir from which the fluid is supplied to said valve, the improvement which comprises maintaining the fluid under substantially uniform gas pressure, and continuously supplying the fluid under said pressure directly to said valve for propelling the fluid to said valve.

* * * * *